US005509658A

United States Patent [19]

Youngblood

[11] Patent Number: 5,509,658

[45] Date of Patent: Apr. 23, 1996

[54] GOLF PUTTER WITH BALL RETRIEVAL DEVICE

[75] Inventor: Robert Youngblood, North Hills, Calif.

[73] Assignee: James E. Freye, Chandler, Ariz.

[21] Appl. No.: 334,232

[22] Filed: Nov. 4, 1994

[51] Int. Cl.[6] ..... A63B 53/04

[52] U.S. Cl. ..... 473/286; 294/19.2

[58] Field of Search ..... 273/162 E, 162 R, 273/162 F, 32 F, 32 R, 193 R, 167 H; 294/19.2

[56] References Cited

U.S. PATENT DOCUMENTS

| | | | |
|---|---|---|---|
| 2,760,807 | 8/1956 | Watson | 294/19.2 |
| 3,300,241 | 1/1967 | Eberwein | 273/162 E |
| 3,374,027 | 3/1968 | Jacobs | 273/162 E |
| 3,632,112 | 1/1972 | Jacobs | 273/162 E |
| 3,708,172 | 1/1973 | Rango | 273/162 E |
| 3,841,639 | 10/1974 | Werner | 273/162 E |
| 4,248,430 | 2/1981 | Kepler | 273/162 E |
| 4,580,784 | 4/1986 | Brill | 273/162 E |
| 4,976,436 | 12/1990 | Serizawa | 273/162 E |
| 5,368,302 | 11/1994 | Thomas | 273/162 E |

*Primary Examiner*—Sebastiano Passaniti
*Attorney, Agent, or Firm*—Schmeiser, Olsen & Watts

[57] ABSTRACT

In a golf putter the head of the putter has a receptacle which has an opening in the bottom of the putter head. The opening is adapted to partially receive a golf ball, the opening having a bevel such that the inner portion of the bevel engages the golf ball and the bevel allows for the smooth movement of the putter over the grass. A plurality of ridges within the receptacle engage the golf ball and hold it to the putter head.

11 Claims, 2 Drawing Sheets

GOLF PUTTER WITH BALL RETRIEVAL DEVICE

FIELD OF THE INVENTION

The present invention relates generally to golfing and golf clubs. In particular the present invention is a golf putter with a ball retrieval device built into the putter head.

BACKGROUND OF THE INVENTION

Due to it's great popularity numerous devices and items have been developed for the sport of golfing. One area that has received a great deal of attention is ball retrieval devices. These devices come in a wide variety of styles but may be generally defined by the particular environment in which they operate.

The first type of ball retrieval devices to be discussed here are those which are used to retrieve golf balls from water hazards. The basic components of such devices generally include a telescoping type handle which enables the user to reach out far enough into the water hazard to retrieve the ball and an open net or cage-like device at one end of the handle which allows for drainage during the retrieval process.

A second type of ball retrieval device is utilized to accumulate a number of golf balls at one time. Such devices can be in the form of automatic sweepers which roll over the balls and sweep them up off the ground and into a bin. Another device of this type is often in the shape of an elongated tube which has a variable or pressure response opening at one end. In this latter device the tube opening is pressed over the ball, and by use of a type of "O" ring securement means the bail is squeezed past the restricted opening and into the tube.

A third type of device is designed to pick the golf ball up off of the ground or from within the putting green golf ball cup. One type of device for accomplishing this function is a movable claw-type grabbing device which is attached to a pole. Generally, a trigger mechanism on the pole handle enables the user to open and close the claw in order to pick up the ball.

Thus, while a myriad of items have attempted to fill the need of providing an acceptable ball retrieval device, to date, none have achieved the type of success that would be expected. It is believed that the failure of these devices to achieve wide use and acceptance have been for several reasons.

Many of the devices are manufactured to stand alone and therefore must be purchased as an addition to one's golf clubs. Such an approach in not only more expensive, but also requires the golfer to carry an additional device in his golf bag.

One shortcoming of the claw-type device as discussed above as well as those devices which used "O" rings is that both can cause damage to the golf ball. More specifically, the claw mechanism can mark the ball when it is moved to it's closed position and the "O" ring devices can mark the ball when it is being pushed through the restricted opening into the receptacle. Perhaps more importantly, one of the most common uses for such devices is in the retrieval of the golf ball from the putting green cup. However, where pressure must be applied to squeeze the ball past the restricted opening or where the claw is being operated it is possible to damage or disrupt the cup. For example, the constant pressure applied against the cup as one tries to push the ball past the restricted opening can cause the cup to become more recessed or alternately may result in a tilting of the cup. Similarly, the claw can engage the drainage openings normally found in the cup and upon removal of the claw the cup may become tilted or otherwise dislodged.

Further difficulties are often encountered when trying to incorporate a ball retrieval feature directly into the golf club. While this approach is generally attempted in order to overcome the fore-mentioned drawbacks of the stand alone device, it can only be successful if the effectiveness of the club is not diminished.

Accordingly, it is an objective of this invention to incorporate a ball retrieval feature into a golf club without diminishing the effectiveness of the club to fulfill its primary function.

Another object of this invention is to develop a bail retrieval device which can be used without damaging the ball being retrieved.

Yet a further object of this invention is to develop a retrieval device which can be used to retrieve a ball from the putting green cup without dislodging or otherwise disrupting the position of the cup.

These and other objects are accomplished with the subject invention as will become apparent from a study of this disclosure.

SUMMARY OF THE INVENTION

The subject invention overcomes the difficulties that were found in prior devices and provides additional benefits not previously obtainable. This is accomplished through the placement of a golf ball receptacle in the base of a golf putter.

In the subject invention the opening of the receptacle has an outer circumference at the bottom surface of the club head. The edge of the outer circumference may be rounded for smoother putting. A beveled section angles inwardly from the outer circumference into the receptacle for a distance of approximately 0.125 inches and terminates at an inner circumference within the receptacle which is 1.65 inches in diameter. Thus, a standard golf ball which is between 1.70 and 1.75 inches in diameter will engage the inner circumference before the ball is halfway into the receptacle.

The inside of the receptacle, including the inner circumference has a plurality of ridges which are formed through the roughing up of this surface with a 150 grit sand paper. This not only enhances the friction in normal usage but also helps to offset any accumulation of dirt, oil, grass or other material which could accumulate and reduce the friction to a point where the ball would not be held properly.

In the preferred embodiment the receptacle cavity is tapered degrees from the outermost circumference at the bottom of the putter up into the head of the putter toward the putters top surface. The depth of the receptacle is 0.875 inches and the 3 degree taper results in a receptacle diameter within the putter head toward the top surface of 1.55 inches.

These features allow the user to pick up a golf ball by simply laying the club on top of the ball such that the ball moves into the receptacle. However, no additional force beyond the weight of the club needs to be placed on the ball in order to have the ball grasped by the club with sufficient strength to lift the ball off the ground. While this is easily accomplished with the subject club which in it's preferred embodiment weighs 17 ounces it has been found that a weight of even 6 ounces is sufficient to engage the ball so as to allow to be lifted.

The size of the club head which, in it's largest measurement, is 3.625 inches from heel to toe allows the user to easily place the club head into a standard 4 inch diameter putting green cup. As previously explained, since the ball can be sufficiently engaged simply by the weight of the club there is no effect on the putting green cup.

For these reason, the subject invention provides a combined putter and ball retrieval device which can engage the ball sufficiently to lift it without needing to add additional pressure beyond the weight of the golf club.

Relative to the functioning of the club as a putter it was discovered that simply placing a hole in the bottom of the putter head would cause a ridge that could result in scuffing or the catching of the club on the grass as the putt was being made. Accordingly, as explained above, the subject invention utilizes a bevel with an outer and inner circumference which enables the club to slide smoothly over a grass surface without becoming caught. Thus, the club functions as effectively with the receptacle as it would without it.

BRIEF DESCRIPTION OF THE DRAWINGS

These and other advantages of the present invention will become more readily apparent upon reading the following detailed description and upon reference to the drawings in which.

DETAILED DESCRIPTION OF THE PREFERRED EMBODIMENTS

The subject invention discloses a golf putter generally designated as 10. The putter 10 has a putter head 12 which, at it's heel portion 14 is attached to a putter shaft 16.

Figure 1:
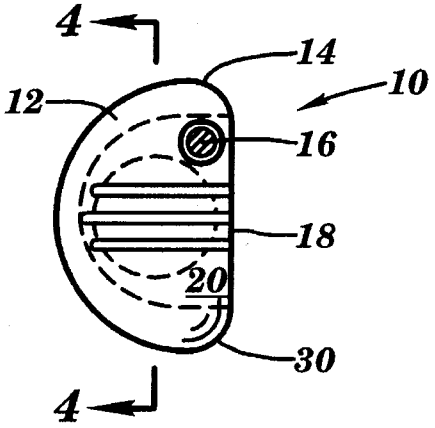
FIG. 1 is a top plan view of the present invention.

As shown in FIG. 1 the putter head is semi-cylindrical in configuration and the head 12 has a front ball striking face 18 and a top surface 20 inlaid in the top surface 20 are directional strips 22 which in the preferred embodiment are made of brass.

Inserted into the head is a unitary brass insert 24 which provides the striking face 18 as well as the golf ball receptacle 26.

Figure 2:
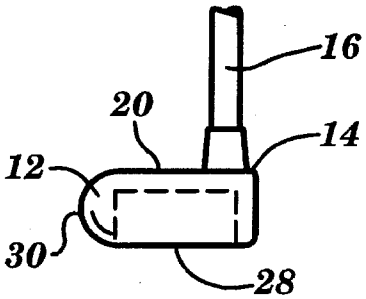
FIG. 2 is a side elevational view of the subject invention showing the receptacle in phanthom.
Figure 3:
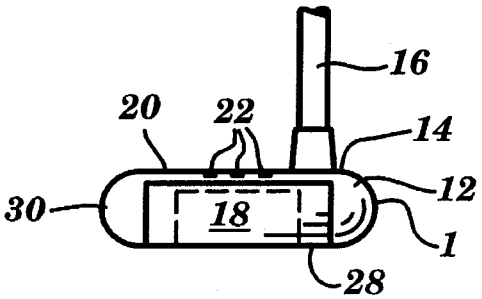
FIG. 3 is a front elevational view of the subject invention.

As shown in FIG. 2 the receptacle 26 opens at the bottom 28 of the head 12. FIG. 3 shows the striking face 18 and it's relationship relative to the club head 12. In the preferred embodiment the toe portion 30 of the putter head 12 is opposite of the heel portion 14 and the distance from the end of the heel portion to the end of the toe portion is 3.625 inches. In the preferred embodiment the entire insert 24 is made of brass.

It should be noted that while the insert is shown as enclosing the entire receptacle 26 the portion of the receptacle toward the top surface 20 need not be brass but may simply be open and utilize the wood of the upper head 12 as the base.

Figure 4:
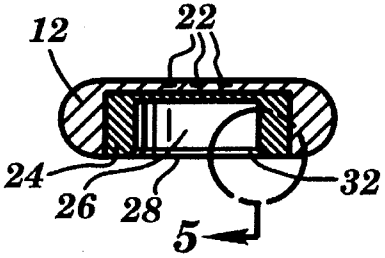
FIG. 4 is a cross-sectional view taken along lines 4—4 of FIG. 1 of the present invention.
Figure 5:
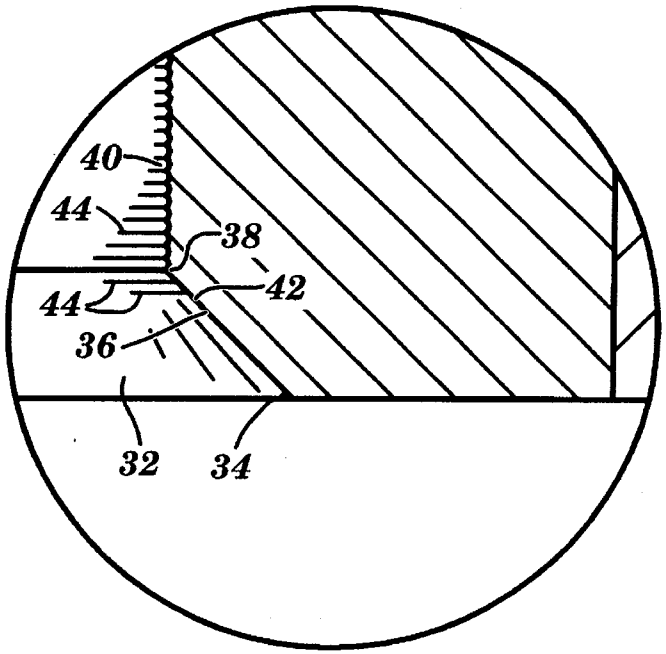
FIG. 5 is an enlarged view of the area designated by the number 5 in FIG. 4 of the present invention.

As shown in FIG. 4 and from the enlarged view of FIG. 5 the receptacle 26 has an opening 32 which has an outer circumference 34. The diameter of the outer circumference is 1.665 inches. Moving from the outer circumference into the receptacle 26 is a bevel portion 36. The bevel begins at the outer circumference 34 and terminates at an inner circumference 38. The length of the bevel from the outer circumference 34 to the inner circumference 38 is 0.125 inches. The diameter of the inner circumference 38 is 1.650 inches.

The inner surface 40 of the receptacle 26 as well as the bevel surface 42 has a plurality of ridges 44 which may be formed either in the machining process or by applying a 150 grit sand paper to the brass after is has been machined. When the golf ball 46 enters the receptacle 26 it engages the ridges 44 closest to the inner circumference 38.

The inner surface 40 on the receptacle 26 has a three degree taper inwardly such that the diameter of the inner circumference 38 is 1.65 inches whereas the diameter at the deepest part of the receptacle which is toward the top surface 20 is 1.55 inches.

Figure 7:
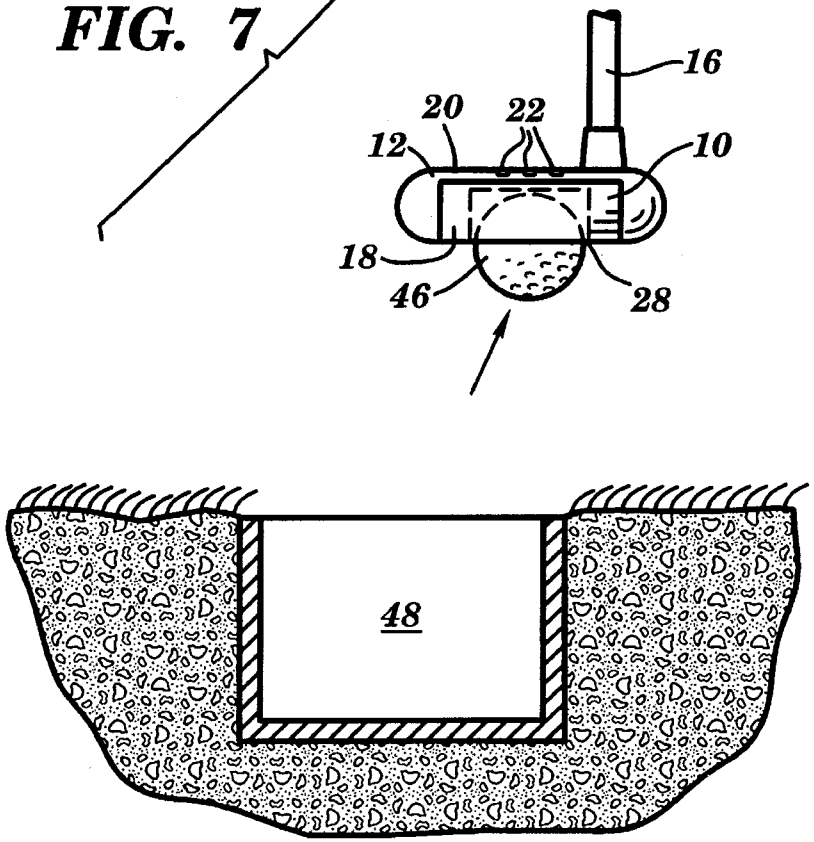
FIG. 7 is a front elevational view similar to that of FIG. 6 showing the golf ball being retrieved.
Figure 6:
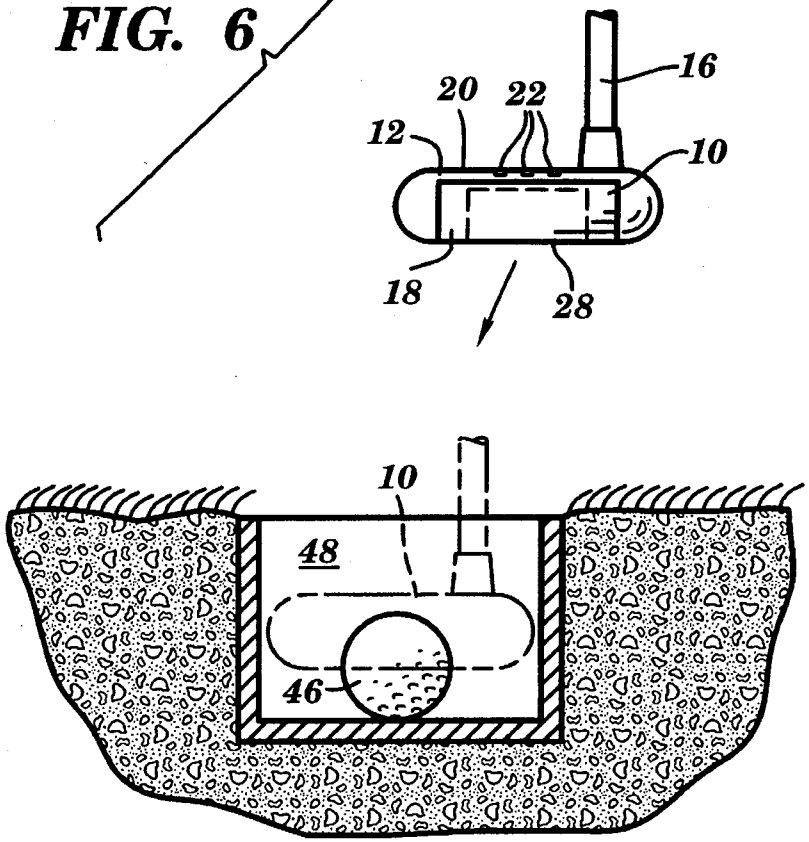
FIG. 6 is a front elevational view showing the subject invention being used to engage a golf ball within a putting green cup.

As shown in FIG. 6 the putter head 10 fits within a typical putting green cup 48 since the cup is circular and generally 4.0 inches in diameter whereas the largest portions of the putter head 12 from the toe portion 30 to the heel portion 14 is only 3.625 inches. As shown in FIG. 7 the ball once gripped by the club head 12 maybe removed from the cup 48. It should be noted that FIG. 6 and 7 are for illustrative purposes only to the extent that they disclose the putting green cup since most cups have various water drainage holes and are configured to center the golf ball in the middle of the cup which makes the use of the subject invention even more effective.

The combination of the above features along with a typical golf ball which has either a surlyn or blata outer surface which is textured enables the balls to be picked up even though less than half of it enters the receptacle 26. The subject invention works equally well with a standard 1.700 inch diameter golf ball as with a 1.750 inch diameter magna golf ball. In the subject invention the weight of the putter 10, which in the preferred embodiment is seventeen ounces, is sufficient to cause the receptacles inner circumference to grip the golf ball with sufficient friction to allow it to be lifted and removed from the putting green cup 48.

In operation, the golfer simply uses the putter as a normal putter. The beveled surface 42 allows the club to slide smoothly over grass surfaces without catching in the receptacle 26. Once the putting has been completed and the golf ball 46 is in the cup 48 the user simply allows the putter head 12 to enter the cup. The weight of the putter 10 is sufficient to secure the golf ball 46 within the receptacle 26 the ridges 44 which are about the inner circumference 38. The golfer then would raise the club head, having applied no additional pressure beyond the weight of the club, in order to withdraw the ball and retrieve it.

The embodiment disclosed herein has been discussed for the purpose of familiarizing the reader with the novel aspects of the invention. Although preferred embodiments of the invention have been disclosed, many changes, modifications and substitutions may be made by one having ordinary skill in the art without necessarily departing from the spirit and scope of the invention as described in the appended claims.

I claim:

1. A golf putter with a ball retrieval element comprising:

a shaft;

a putter head attached to said shaft, said head having a front ball striking surface, a top surface and a bottom surface; and a receptacle within the putter head, said receptacle having an opening in said bottom surface whereby said receptacle is adapted to partially receive a golf ball, said opening having an outer circumference of predetermined dimensions, adjacent to the outer most circumference, moving into the receptacle, is a beveled portion, a top of the beveled portion being defined by the outer circumference and a bottom of the beveled portion being defined by the inner circumference which is smaller than said outer circumference thereby enabling the club to slide smoothly over a grass surface.

2. The invention of claim 1 wherein the inner circumference is less than 1.700 inches and the outer circumference has an edge which is rounded.

3. The invention of claim 1 further comprising a plurality of ridges located on a portion of the receptacle which grips the ball when the receptacle is placed over said ball, said ridges gripping the ball such that the ball may be lifted and held partially within the receptacle.

4. The invention of claim 3 wherein the receptacle tapers inwardly from the inner circumference into the putter head toward the top surface of the head.

5. The invention of claim 4 wherein the head has a heel portion at one end of the head and a toe portion at another end of the head, the distance between the heel and the toe portions being less than four inches such that the head fits within a four inch putting green golf ball cup.

6. The invention of claim 5 wherein the ball contacting portions of the receptacle are made of a soft metal such as brass.

7. The invention of claim 6 wherein the outer circumference forms an edge which is rounded.

8. The invention of claim 6 wherein the face and the receptacle are formed from a unitary piece of metal.

9. The invention of claim 8 wherein the diameter of the outer circumference is about 1.665 inches and the diameter of the inner circumference is about 1.650 inches, the width of the bevel from the outer circumference to the inner circumference being about 0.125 inches, whereby the ball is engaged by the inner circumference.

10. A golf putter with a ball retrieval element comprising:

a shaft;

a putter head attached to said shaft, said head having a front ball striking surface, a top surface and a bottom surface;

a receptacle in the putter head, said receptacle having an opening in said bottom surface whereby said receptacle is adapted to partially receive a golf ball, said receptacle tapering inwardly from an inner circumference into the putter head toward the top surface of the head; and a plurality of ridges on a portion of the receptacle which contacts the ball when the receptacle is placed over the ball, said ridges gripping the ball whereby the ball may be lifted and held partially within the receptacle.

11. The invention of claim 10 wherein the head has a heel portion at one end of the head and a toe portion at the other end of head, the distance between the heel and toe portions being less than four inches such that the head fits within a four inch diameter putting green golf ball cup.

* * * * *

UNITED STATES PATENT AND TRADEMARK OFFICE

CERTIFICATE OF CORRECTION

PATENT NO. : 5,509,658

DATED : April 23, 1996

INVENTOR(S) : Robert Youngblood

It is certified that error appears in the above-indentified patent and that said Letters Patent is hereby corrected as shown below:

On the title page, item [73] Assignee, "Freye" to read --Frye--.

Signed and Sealed this

Thirteenth Day of August, 1996

*Attest:*

Bruce Lehman

BRUCE LEHMAN

*Attesting Officer*

*Commissioner of Patents and Trademarks*